United States Patent [19]

Melzer et al.

[11] Patent Number: 4,951,566

[45] Date of Patent: Aug. 28, 1990

[54] SCREEN PRINTING APPARATUS

[76] Inventors: Roland Melzer, Glatzer Weg 9; Rainer Melzer, Kaiserstrasse 24, both of D-5830 Schwelm, Fed. Rep. of Germany

[21] Appl. No.: 370,794

[22] Filed: Jun. 23, 1989

[30] Foreign Application Priority Data

Mar. 18, 1989 [DE] Fed. Rep. of Germany ..... 8903424

[51] Int. Cl.[5] ..... B41L 13/02; B41L 13/18

[52] U.S. Cl. ..... 101/123; 101/114

[58] Field of Search ..... 101/123, 114

[56] References Cited

U.S. PATENT DOCUMENTS 2,940,322 6/1960 Uhing ..... 74/22

3,828,671 8/1974 Fuchs ..... 101/123

3,946,668 5/1976 Douthwaite et al. ..... 101/123

4,404,903 9/1983 Cronin ..... 101/123

*Primary Examiner*—Edgar S. Burr

*Assistant Examiner*—Ren Yan

*Attorney, Agent, or Firm*—Watson, Cole, Grindle & Watson

[57] ABSTRACT

A screen printing apparatus includes a mesh screen mounted on screen frame, a wiper carrier reciprocably mounted above the screen, and a drive shaft mounted laterally of the wiper carrier and extending in the direction of reciprocable movement of the carrier, the wiper carrier being journaled on and guided to move along the shaft and being pivotable about the shaft.

7 Claims, 1 Drawing Sheet

SCREEN PRINTING APPARATUS

BACKGROUND OF THE INVENTION

This invention relates generally to a screen printing apparatus in which a web to be printed is disposed beneath a printing screen and at least one wiper moves across the screen to force dye through the screen meshes to effect printing. More particularly, the wiper is mounted on a wiper carrier driven to reciprocate relative to the screen. For proper printing a precise guidance of the wiper carrier is required.

SUMMARY OF THE INVENTION

It is an object of the present invention to provide a screen printing apparatus in which the screen carrier is guided in a simple and efficient yet highly effective and accurate manner.

A further object is to provide such a screen printing apparatus having a combined drive and guide system for the wiper carrier.

A still further object of the invention is to provide such a screen printing apparatus wherein the wiper carrier may be lifted from the screen in a simple manner so as to facilitate access to the screen frame and without interference with precise guiding.

According to the invention, the foregoing and other objects are effected by providing a drive shaft mounted on a support frame laterally of the wiper carrier and extending in the direction of reciprocation of the carrier. The carrier is journaled on the shaft, is guided therealong and is driven to reciprocate by the shaft. The shaft further defines an axis about which the wiper carrier may be pivotably lifted so as to provide access to the screen frame. The drive shaft forms part of a so-called "roller ring gear" produced by Uhing KG of Kiel, Germany and sold under the designation Uhing-Lineartriebe UWN. This type gearing is described in U.S. Pat. No. 2,940,322, the disclosure of which is specifically incorporated herein by reference. Briefly, this gearing comprises a smooth shaft which need only be driven for rotation about its central axis. A gear box is mounted on the shaft and includes tilted rollers frictionally engaging the shaft such that a force is transmitted to the gear box which moves it along the shaft, the direction of movement depending on the tilt angle of the rollers which may be switched. Thus, the gear box may reciprocate along the shaft between two end positions defined by stops which actuate the tilt angle switch. The smooth shaft is suitable as a bearing and guide for the wiper carrier. The other end of the carrier remote from the shaft may be supported on a rail, such as by means of a ball bearing or the like, the rail extending parallel to the shaft.

DETAILED DESCRIPTION OF THE INVENTION

Figure 2:
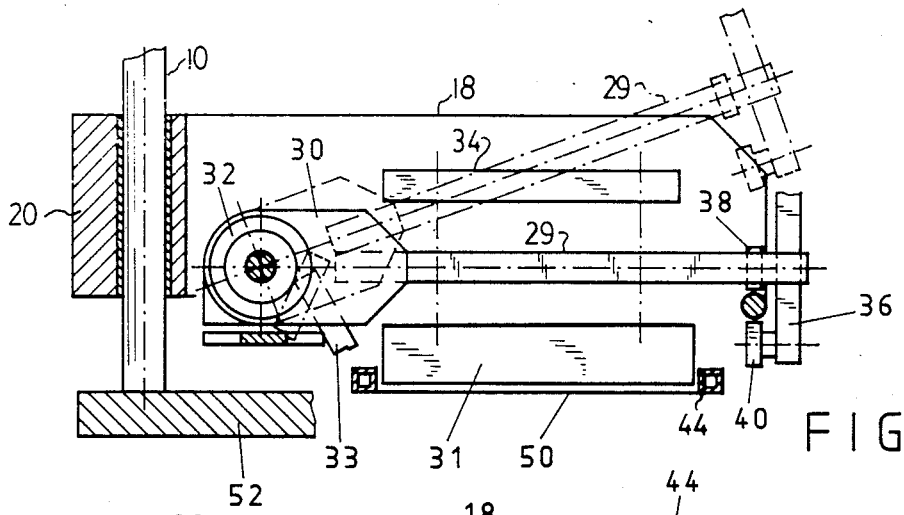
FIG. 2 is a partial sectional view of the apparatus taken substantially along the line 2—2 of FIG. 1.
Figure 1:
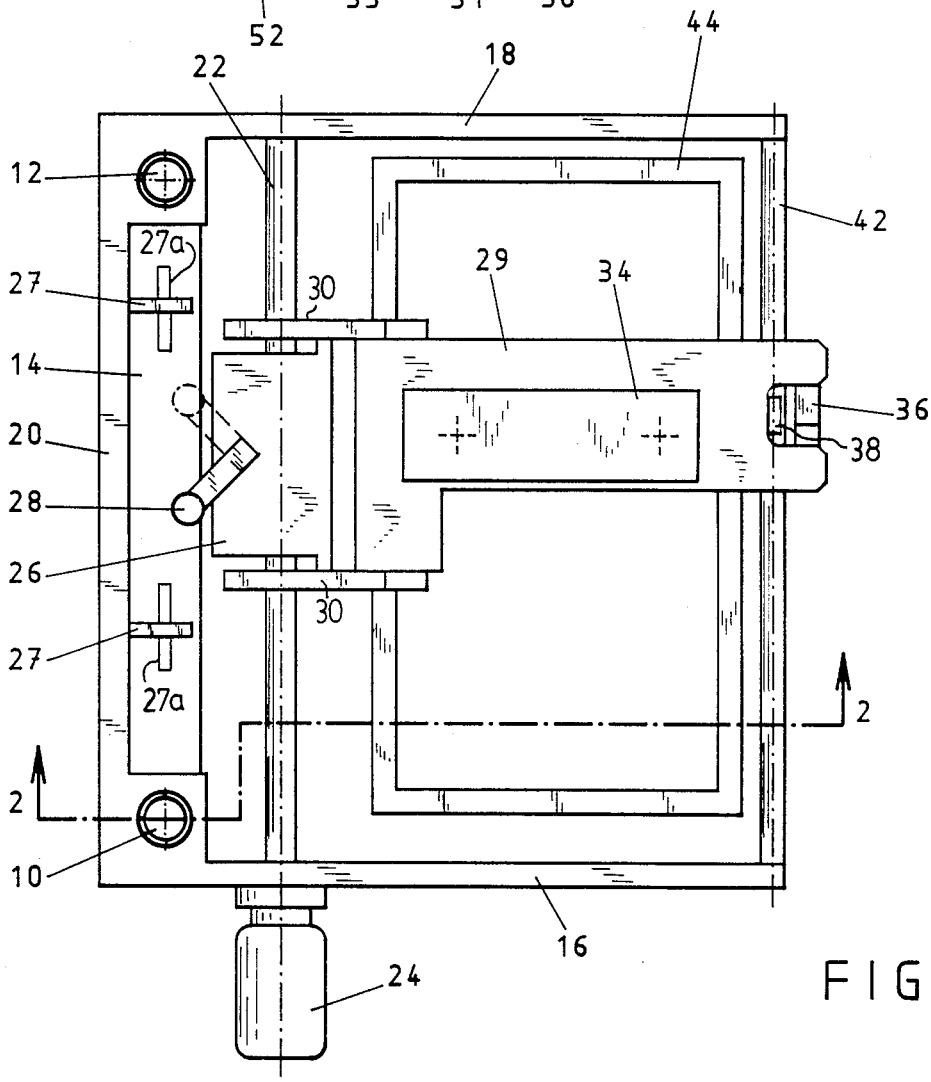
FIG. 1 is top plan view of the apparatus according to the invention.

The apparatus includes a pair of spaced upright support rods 10 and 12 which support all the elements of the screen printing apparatus including those not illustrated in detail for the sake of clarity. A support frame includes a horizontal plate 14 mounted on rods 10 and 12. Vertical side walls 16 and 18 and a rear wall 20 are bolted to plate 14 and form part of the support frame.

A smooth shaft 22 is rotatably journaled in side walls 16 and 18, the shaft being driven for uniform rotation about its central axis in a given direction of rotation. A drive motor 24 coupled to the shaft functions as the drive. A roller ring gear 26 of the Uhing type is disposed on shaft 22 and is secured against rotation about the shaft in the normal manner. The ring gear is frictionally driven to move axially along the shaft, the direction of such movement being reversed each time a switchover lever 28 on the gear abuts against one or two stops 27 mounted on plate 14. In such manner, gear 26 performs back and forth movement along shaft 22 without the need to reverse the rotation of the shaft.

Shaft 22 extends through suitable openings provided in flanges 30 embracing gear 26 on opposite ends. Flanges 30 are slidably guided on shaft 22 by means of sliding-fit bushings 32. A wiper carrier 29 is bolted to flanges 30. In the present embodiment, wiper carrier 29 includes a horizontal plate 34 which supports holding, driving, control and adjustment elements for at least one wiper blade 31. The wiper performs a wiping movement within each back and forth cycle of the carrier. Pneumatic drive means (not shown) controlled by position switches are suitable for this purpose.

At its end remote from shaft 22, wiper carrier 29 is provided with a vertical ledge 36 which supports a first roller 38 and a second roller 40. First roller 38 rolls along a rail 42 forming part of the support frame and connecting side walls 16, 18 adjacent to free ends thereof. Second roller 40 engages beneath rail 42 and impedes any intentional lifting of wiper carrier 29 from the rail. However, roller 40 may be withdrawn or pivoted away from rail 42 so that a screen frame 44 located beneath the wiper carrier is conveniently accessible upon pivotal upward movement of the carrier to its position shown in phantom outline in FIG. 2.

A support (not shown) for screen frame 44 with its mesh screen 50 mounted thereon, and for a web table 52 beneath the screen are also fixed on rods 10 and 12 such that a free space is defined between the rods. A web to be printed may therefore be moved between the rods, i.e., transverse to the axis of shaft 22 but also in a direction parallel to the shaft axis.

Stops 27 may be adjustable in a direction parallel to shaft 22 by the provision of guides **27*a*** or the like to permit proper selection of start and stop for a given printing operation.

A latch tooth 33 is provided on the carrier for latching the carrier in its lifted position shown in phantom outline in FIG. 2.

Obviously, many alterations and variations of the present invention are made possible in the light of the above teachings. It is therefore to be understood that within the scope of the appended claims the invention may be practiced otherwise than as specifically described.

What is claimed is:

1. A screen printing apparatus comprising:

a table for supporting a web to be printed, a screen frame overlying said table and supporting a printing screen, a support frame mounted on said table, a wiper carrier supporting a wiper blade and mounted on said support frame above said screen for reciprocation along a predetermined direction, a single shaft extending in said predetermined direction wiper carrier guide means for guiding said wiper carrier along said direction, pivot means for pivotally mounting said wiper carrier so as to pivot said wiper carrier away from said screen frame, and wiper carrier drive means including a motor mounted on said support frame for reciprocating said wiper carrier, said single shaft being rotated by said motor, said wiper carrier drive means further including means reponsive to rotation of said single shaft to drive said wiper carrier back and forth along said screen frame, said single shaft also serving as said wiper carrier guide means and said wiper carrier pivot means.

2. The apparatus according to claim 8, wherein said support frame includes a rail extending parallel to said shaft, said carrier having an end remote from said shaft, and said end being supported on said rail for movement therealong.

3. The apparatus according to claim 8, wherein a ring gear is mounted on said shaft, said carrier being coupled to said gear.

4. The apparatus according to claim 3, wherein said carrier has at least one flange thereon with an opening through which said shaft extends, said flange bearing against said gear so as to be driven thereby.

5. The apparatus according to claim 8, wherein said table has upright support rods on which said support frame is mounted a predetermined distance above said table to permit unobstructed movement of the web to be printed.

6. The apparatus according to claim 8, wherein latch means on said carrier is provided for latching said carrier in a pivotally moved position away from said table.

7. The apparatus according to claim 3, wherein stop means are provided on said support frame in spaced apart relationship and are adjustable in said direction, and means on said gear cooperating with said stop means for inverting the direction of movement of said carrier.

* * * * *